US007442151B1

(12) United States Patent
Berdegue

(10) Patent No.: US 7,442,151 B1
(45) Date of Patent: Oct. 28, 2008

(54) SWIMMING DEVICE AND METHOD FOR RESTRAINING A SWIMMER WITHIN A BODY OF WATER

(76) Inventor: Carlos Eduardo Berdegue, 316 Lilac La., San Antonio, TX (US) 78209

( * ) Notice: Subject to any disclaimer, the term of this patent is extended or adjusted under 35 U.S.C. 154(b) by 0 days.

(21) Appl. No.: 11/893,148

(22) Filed: Aug. 15, 2007

Related U.S. Application Data

(63) Continuation-in-part of application No. 10/945,752, filed on Sep. 21, 2004, now abandoned.

(51) Int. Cl.
*A63B 31/00* (2006.01)

(52) U.S. Cl. ..... 482/55; 482/111; 434/254

(58) Field of Classification Search ..... 482/43, 482/55, 56, 97, 111, 121, 122, 124; 434/254
See application file for complete search history.

(56) References Cited

U.S. PATENT DOCUMENTS

| | | | | |
|---|---|---|---|---|
| 2,684,109 | A | 7/1954 | Youmans | |
| 3,512,416 | A * | 5/1970 | Hohwart | 73/379.09 |
| 4,095,657 | A * | 6/1978 | Hohwart | 482/55 |
| 4,247,096 | A * | 1/1981 | Schmitt | 482/55 |
| 4,248,419 | A * | 2/1981 | Hohwart | 482/55 |
| 4,524,711 | A * | 6/1985 | Ashrow | 482/55 |
| 4,530,497 | A * | 7/1985 | Moran et al. | 482/55 |
| 5,234,392 | A | 8/1993 | Clark | |
| 5,556,353 | A | 9/1996 | Beers | |
| 5,846,167 | A * | 12/1998 | Liu et al. | 482/55 |
| 6,251,049 | B1 | 6/2001 | Milton | |
| 6,521,049 | B1 * | 2/2003 | Rolfson | 134/10 |

* cited by examiner

*Primary Examiner*—LoAn H. Thanh
*Assistant Examiner*—Tam Nguyen
(74) *Attorney, Agent, or Firm*—Rafael V. Baca; Baca Law Firm, PLLC

(57) ABSTRACT

A device for restraining a swimmer in a variety of settings including a post, tie portion, tether assembly, and restraining belt coupled to the tether assembly and swimmer. An anchor assembly provides an anchoring collar fixed at one end and in sliding engagement with the post at another end. In operation, a swimmer applies a variable tension from the restraining belt across the tether assembly to the tie portion of the post. In sliding engagement with the post, the anchoring collar provides a tensile force to the post to counteract the swimmer's variable tension and to maintain the post both in a longitudinal position within the body of water and in continuous contact with the underwater floor. The device may include a base assembly that is releasably coupled to the post and enables the post to pivot in the direction of the tensile force applied by the tethered swimmer.

11 Claims, 12 Drawing Sheets

SWIMMING DEVICE AND METHOD FOR RESTRAINING A SWIMMER WITHIN A BODY OF WATER

CROSS REFERENCE TO RELATED APPLICATION

This U.S. non-provisional patent application is a continuation-in-part of U.S. non-provisional patent application Ser. No. 10/945,752, now abandoned, entitled "A STATIONARY SWIMMING DEVICE AND METHOD FOR FIXATING A USER'S LOCATION WITHIN A BODY OF WATER WHILE SWIMMING" and filed Sep. 21, 2004, having at least one co-inventor in common with this application, Carlos Eduardo Berdegue, and which the content of this related application is incorporated herein by reference, and claims priority and benefit under 35 U.S.C. §120.

BACKGROUND OF THE INVENTION

1. Field of the Invention

The present invention generally relates to an apparatus for fixating a user's location within a body of water while swimming. More particularly, but not by way of limitation, the present invention relates to a device and method for stationary swimming by applying a slideable anchoring collar to maintain horizontal stability of the post as a tethered swimmer applies a variable force to the post.

2. Description of the Related Art

The added health benefits of swimming are well known. A consistent regimen of swimming builds strength and endurance without aggravating a body's joints, ligaments, and muscles. Accordingly, swimming is a popular form of exercise, physical training, and physical therapy for humans and animals alike.

Oftentimes large swimming pools, lakes, or other shorelines are not readily accessible to many swimmers. On the other hand, smaller man-made pools that are configured for recreation or therapy are more prevalent and, thus, accessible to many swimmers. However, it is often difficult for swimmers within these smaller pools to maneuver and undergo long distances.

As a result, methods were gradually developed that permitted movement associated with swimming while restricting a swimmer to a confined location within the pool. Commonly, an apparatus was provided for restraining a swimmer in place within a small pool. In this manner, the swimmer not only gained the benefits of strength and endurance attributed to swimming but was also confined to a small area by which coaches, trainers, and therapists could more accurately measure that swimmer's progress.

After comparison with prior art, the present invention herein described identifies any and all improvements, unexpected results, synergies, and other evidence that provides at least one result that is more than what might be predictable to one skilled in the art. Among other unpredictable results, the present invention provides for a stationary swimming device that facilitates portable transport and ease of use from one pool to another as well as along the shores of a body of water such as lake or beach. The present invention also provides for a stationary swimming device that is easy to assemble and use and provides for an anchoring collar facilitates comfort and resistance to keep a longitudinal post in place within a body of water as a tethered swimmer applies a variable force to the post.

SUMMARY OF THE INVENTION

Aspects of the invention are found in a stationary swimming device for fixating a user's location within a body of water while swimming. In one aspect, the stationary swimming device includes a post, a tie portion coupled to the post and positioned above the body of water, and a tether assembly coupled to the tie portion. The stationary swimming device includes an anchor assembly having an anchoring collar that is fixed at one end and in sliding engagement with the post at another end. The stationary swimming device further includes a restraining belt that is coupled to the tether assembly and positioned on the user. In operation, while swimming, the user supplies a variable tension from the restraining belt across the tether assembly to the tie portion and the post. In sliding engagement with the post, the anchoring collar provides a tensile force to the post to counteract the swimmer's variable tension and to maintain stability of the post within the body of water. In effect, the anchor and tether assemblies cooperate to supply a compressive force through the post to an underwater floor, beneath the body of water and in contact with the post. The tensile relationship between the anchoring collar and tethered swimmer maintains the post in a longitudinal position within the body of water and in continuous contact with the underwater floor.

In one aspect, the post may be constructed of a plurality of segments. The plurality of segments may lock in position so as to ensure that a desired length is maintained for the post. In one aspect, a post, in whole or in part, may be constructed of telescoping segments for selectively adjusting overall length of the post.

The stationary swimming device may be applied to a variety of settings such as an underwater floor for a man-made or natural pool and along the shoreline of a costal bed, lake bed, river bed, and stream bed. Accordingly, a post of a stationary swimming device may be configured to optimally accommodate the structural features associated with a particular underwater floor. Specifically, in one aspect, the post may include a base portion. The base portion may be configured for optimal engagement with the structural features of any particular underwater floor. In one aspect, the stationary swimming device may further include an end cap for disposal on the post. The end cap may be configured for optimal engagement with the underwater floor. A variety of interchangeable end caps and other anchoring devices may be provided to at one end of the post to accommodate different structural features of any number of underwater floors.

In another aspect, the stationary swimming device includes a base assembly that is releasably coupled to the post. The base assembly includes a base element for placement on the underwater floor and a swivel coupling arrangement for joining the base element with the base portion of the post. In operation, to provide comfort and physical interaction with the swimmer, the swivel coupling arrangement enables the pole to pivot with respect to the base element in the direction of the tensile force applied by the tethered swimmer.

Other aspects, advantages, and novel features of the present invention will become apparent from the detailed description of the present invention when considered in conjunction with the accompanying drawings.

BRIEF DESCRIPTION OF THE DRAWINGS

The present invention is illustrated by way of example and not by limitation in the accompanying figures, in which like references indicate similar elements, and in which.

Skilled artisans appreciate that elements in the Figures are illustrated for simplicity and clarity and have not necessarily been drawn to scale. For example, the dimensions of some of the elements in the Figures may be exaggerated relative to the other elements to help improve understanding of the embodiments of the present invention.

DETAILED DESCRIPTION

For a more complete understanding of the present invention, preferred embodiments of the present invention are illustrated in the Figures. Like numerals being used to refer to like and corresponding parts of the various accompanying drawings. It is to be understood that the disclosed embodiments are merely exemplary of the invention, which may be embodied in various forms.

Figure 1:
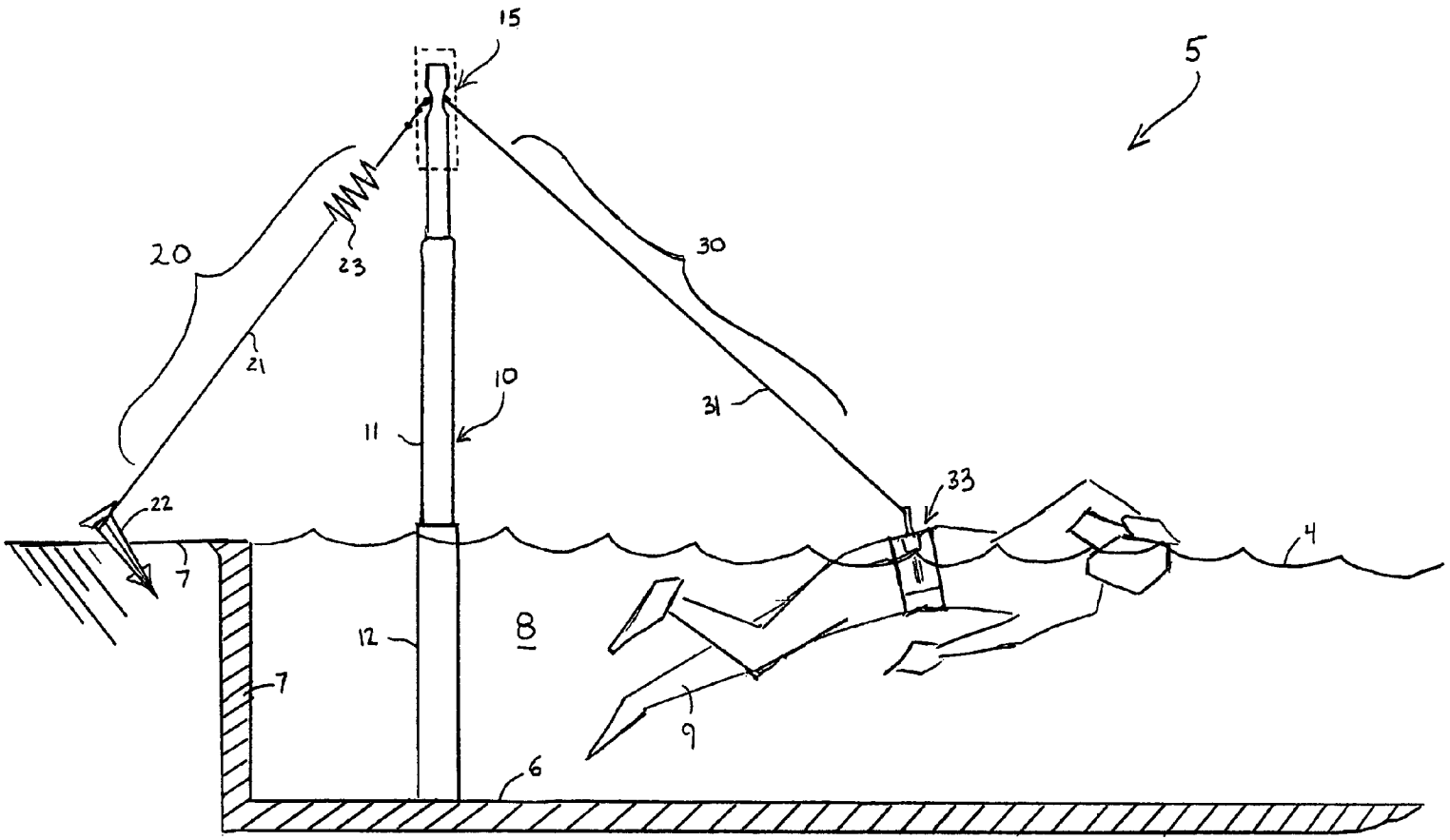
FIG. 1 is a side elevational view illustrating a stationary swimming device for fixating a user's location within a body of water while swimming according to the present invention, the device including a post positioned longitudinally within the body of water and in continuous contact with the underwater floor.

FIG. 1 illustrates one aspect, among others, of a stationary swimming device 5. The stationary swimming device 5 fixates a user's 9 location within a body of water 8 while swimming.

The body of water 8 forms a top surface 4. As shown in FIG. 1, the top surface 4 is a horizontal plane positioned below a surrounding atmosphere. The body of water 8 in FIG. 1 is positioned on an underwater floor 6. The underwater floor 6 of FIG. 1 is positioned below and parallel to the top surface 4. In other aspects of the invention, the underwater floor 6 may be positioned below and substantially parallel to the top surface 4. It should be added that in this disclosure and appended claims the "underwater floor" refers to any horizontal or substantially horizontal surface below a body of water including, among others, the floor of a man-made pool, a sea bed, lake bed, a pond bed, a river bed, and a stream bed.

Accordingly, FIG. 1 shows the user 9 swimming within a man-made pool. The bottom of the pool is defined by the underwater floor 6 and the side of the pool is defined by a containment wall 7 perpendicularly coupled to the underwater floor 6. It should also be added that the user 9 may either be a human or an animal.

The stationary swimming device 5 includes a post 10. The post 10 defines a tie portion 15. As shown in FIG. 1, the tie portion 15 is positioned above the top surface 4 of the body of water 8.

In one exemplary embodiment, the post 10 may be constructed of a single piece member. Operatively, a post composed of a single piece member provides greater mechanical strength to the stationary swimming device 5 than a post composed of many segments.

In one exemplary embodiment, the post 10 may be composed of a plurality of segments. Operatively, a post composed of a plurality of segments may account for variations in overall length of a post.

Illustratively, FIG. 1 shows a first telescoping segment 11 extending outwardly from a second telescoping segment 12. Those of ordinary skill in the art will readily recognize any suitable number of segments for positioning the tie portion 15 above the top surface 4 so as to permit the user 9 to swim away from the post at any desired distance.

The device 5 of FIG. 1 further includes an anchor assembly 20 and a tether assembly 30. The anchor assembly 20 and the tether assembly 30 are each respectively coupled to the tie portion 15.

The anchor assembly 20 includes an anchor 22. Shown in FIG. 1, the anchor 22 is in secured engagement to a surrounding environment adjacent to the underwater floor 6. In particular, the anchor 22 of FIG. 1 comprises a stake driven into the earth located adjacent to the man-made pool that defines the underwater floor 6. In one exemplary embodiment, the anchor 22 may be secured to the underwater floor 6. In this disclosure and appended claims the term "secured" refers to being attached to.

The anchor assembly 20 further includes at least one anchor cord 21. In one exemplary embodiment, the anchor assembly 20 may include a plurality of anchor cords. The at least one anchor cord 21 is positioned between the anchor 22 and the tie portion 15 of the post 10. In operation, the anchor 22 supplies a tension across the anchor chord 21 to the tie portion 15 so as to counteract tensile forces applied to the tie portion 15 by the tether assembly 30. In one exemplary embodiment, the anchor assembly 20 is configured to be releasable from the tie portion 15.

In one exemplary embodiment, the anchor assembly 20 may further include a damper 23. The damper 23 is positioned along and coupled to the anchor chord 21. Operatively, the damper 22 dissipates any shock forces exerted by the user 9 as the user continuously pulls against the tether assembly 30 while swimming.

The tether assembly 30 includes at least one tether cord 31. The at least one tether cord 31 is coupled to the tie portion 15. In one exemplary embodiment, the tether assembly 30 includes a plurality of tether cords.

The stationary swimming device 5 further includes a restraining belt 33. The restraining belt 33 is positioned on the user 9 while swimming through the body of water 8. As shown in FIG. 1, the at least one tether cord 31 is positioned between and coupled to both the tie portion 15 and the restraining belt 33. In one exemplary embodiment, the tether assembly 30 is configured to be releasable from the tie portion 15.

In operation, the user 9 supplies a tension from the restraining belt 33 across the tether assembly 30 to the tie portion 15 of the post 10 to form an angular relationship between the tether assembly 30 and the anchor assembly 20 relative to the tie portion 15. In effect, this angular relationship maintains the post 10 in a longitudinal position within the body of water 8 and in contact with the underwater floor 6 that is parallel to the top surface 4. In particular, the anchor and tether assemblies 20, 30, respectively, cooperate to supply a compressive force through to post 10 to the underwater floor 6.

Referring to FIG. 1, a method for swimming within a body of water may be appreciated. In operation, the restraining belt 33 is positioned on the user 9. As the user 9 swims through the body of water 8, a tension is supplied from the restraining belt 33 across the tether assembly 30 to the tie portion 15 of the post 10. As a result of the tension supplied from the user 9, an angular relationship is formed between the tether assembly 30 and the anchor assembly 20 relative to the tie portion 15. This angular tensile relationship supplies a compressive force through the post 10 to the underwater floor 6. This steady compressive force enables the post 10 to be positioned longitudinally within the body of water 8 and in continuous contact with the underwater floor 6.

Figure 2:
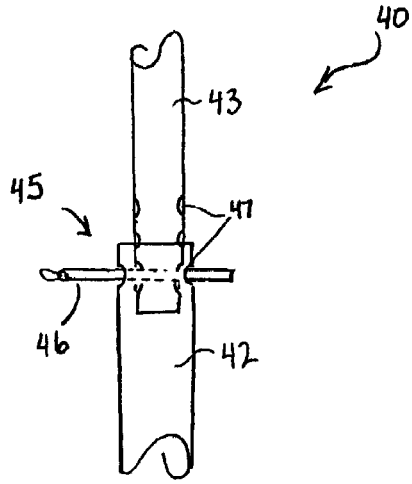
FIG. 2 is an orthographic view illustrating one exemplary embodiment of a post of a stationary swimming device including a plurality of telescopically extending segments.

FIG. 2 illustrates one exemplary embodiment of a post 40 of a stationary swimming device. The post 40 is composed of a plurality of segments. In particular, in one exemplary embodiment, the post 40 may be composed of a plurality of telescoping segments. Operatively, one segment extends outwardly from an adjacent segment to establish a telescoping effect. In one exemplary embodiment, at least one segment of the plurality of telescoping segments may be variably adjusted so as to achieve a desired overall length of the post 40.

As shown in FIG. 2, at least one segment of the plurality of segments locks in position to ensure that the ultimate desired length of the post 40 is maintained. Accordingly, the post 40 includes a first segment 42 and a second segment 43 telescopically extending from the first segment 42. The second segment 43 remains in an extended position away from the first segment 42 via a locking assembly 45. In one exemplary embodiment, the locking assembly 45 includes a series of eyelets 47 and a securing pin 46. In operation, the securing pin 46 passes through the respective eyelets 47 located on the both the first segment 42 and the second segment 43 to thus lock the segments in position.

Figure 3:
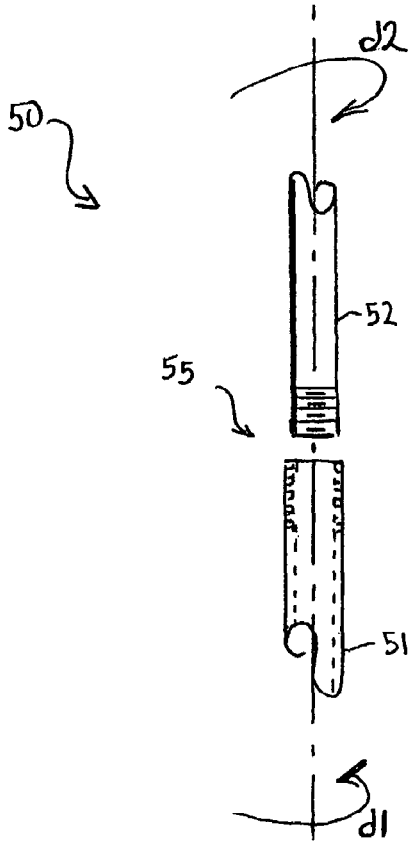
FIG. 3 is an orthographic view illustrating one exemplary embodiment of a post of a stationary swimming device including a plurality of telescopically extending segments.

FIG. 3 illustrates one exemplary embodiment of a post 50 of a stationary swimming device. The post 50 is composed of a plurality of segments. In particular, in one exemplary embodiment, the post 50 is may be composed of a plurality of telescoping segments.

The post 50 of FIG. 3 includes a first segment 51 and a second segment 52 extending telescopically from the first segment 51. The first segment 51 and the second segment 52 are fixed at a desired length via locking assembly 55.

In one exemplary embodiment, the locking assembly 55 comprises a twist-screw assembly. Accordingly, the first segment 51 and the second segment 52 are independently twisted in opposing angular directions, d1, d2 respectively. This twisting locks the first segment 51 and the second segment 52 in position with one another to provide the post 50 with a desired length.

Figure 4:
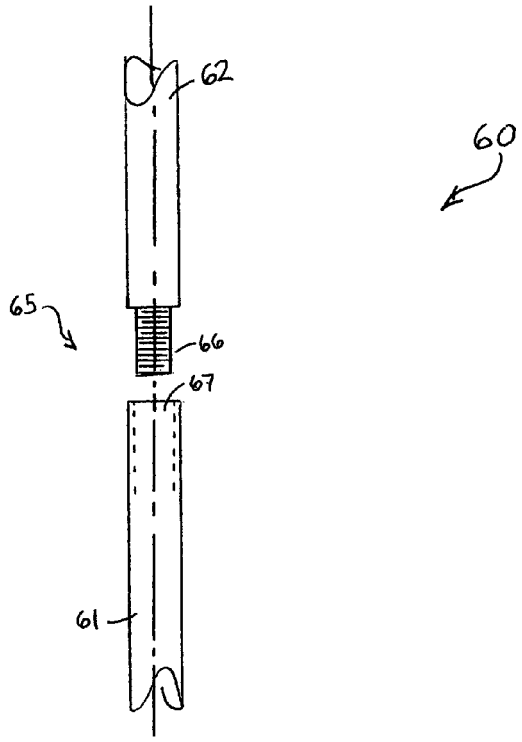
FIG. 4 is an orthographic view illustrating one exemplary embodiment of a post of a stationary swimming device including a plurality of segments.

FIG. 4 illustrates one exemplary embodiment of a post 60 of a stationary swimming device. The post 60 is composed of a plurality of segments. In FIG. 4, the post 60 includes a first segment 61 and a second segment 62. Variations in overall length of the post 60 may be accomplished by securing adjacent ends of the first and second segments 61, 62 via a lock assembly 65.

Figure 5:
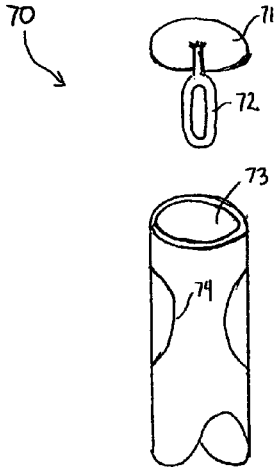
FIG. 5 is an isometric view illustrating one exemplary embodiment of a tie portion defined by a post.

FIG. 5 illustrates one exemplary embodiment of a tie portion 70 formed at one end of a post. In particular, as shown in FIG. 5, the tie portion 70 is formed by a hollowed-out member 73. The hollowed-out member 73 is configured for receiving a hitch 72 therein. The hollowed-out member 73 is further configured to define connecting apertures 74. Operatively, a tether assembly and an anchor assembly each pass through the connecting apertures 74 to secure to the hitch 72 positioned within the hollowed-out member 73.

Figure 6:
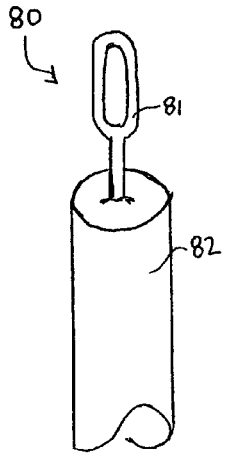
FIG. 6 is an isometric view illustrating one exemplary embodiment of a tie portion defined by a post.

FIG. 6 illustrates one exemplary embodiment of a tie portion 80 formed at one end of a post. The tie portion 80 includes a hitch 81 disposed on hitch base 82. In operation, a tether assembly and an anchor assembly are coupled to the hitch 81 atop the hitch base 82.

Figure 7:
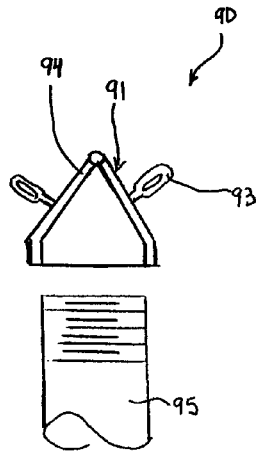
FIG. 7 is an orthographic view illustrating one exemplary embodiment of a tie portion of a post, the tie portion including a hitch unit for establishing a desired compressive force therefrom and through the post.

FIG. 7 illustrates one exemplary embodiment of a tie portion 90 formed at one end of a post. Specifically, the tie portion 90 includes a hitch unit 91 and a mounting base 95. Operatively, the hitch unit 91 is positioned on the mounting base 95. In one exemplary embodiment, the hitch unit 91 is releasable from the mounting base 95.

The hitch unit 91 of FIG. 7 includes at least at least one hitch 93. The at least one hitch 93 may be positioned on the hitch unit 91 so as to facilitate an optimal angular relationship between a tether assembly and an anchor assembly relative to the tie portion 90.

In one exemplary embodiment, shown in FIG. 7, the hitch unit 91 may comprise a hingedly configured body 94 for facilitating variable angular placement of the at least one hitch 93 to form different angular relationships between a tether assembly and an anchor assembly relative to the tie portion 90.

Figure 8:
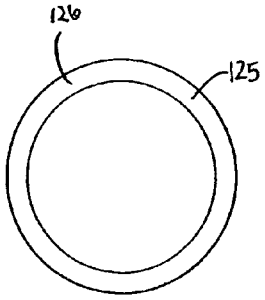
FIG. 8 is an orthographic view illustrating one exemplary embodiment of a base portion defined by the post, an annular member is formed about the diameter of the base portion as shown.

FIG. 8 illustrates one exemplary embodiment of a base portion 125 of a post. As shown in FIG. 8, the base portion 125 includes an annular member 126. In one exemplary embodiment, the annular member 126 is configured to receive a portion of an underwater floor therein. In one exemplary embodiment, the annular member 126 is configured for receiving weighted material therein. The weighted material is provided for stabilizing the base portion 125 with respect to an underwater floor.

Figure 9:
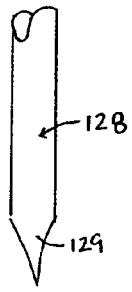
FIG. 9 is an orthographic view illustrating one exemplary embodiment of a base portion wherein the base portion is configured for fixed engagement with an underwater floor.

FIG. 9 shows one exemplary embodiment of a base portion 128 of a post. The base portion 128 includes a stake element 129. In operation, the stake element 129 is configured for fixed engagement with an underwater floor. In this disclosure and appended claims the term "fixed engagement" refers to being solidly embedded within or secured to an underwater floor.

Figure 10:
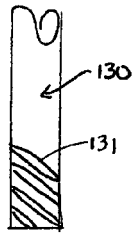
FIG. 10 is an orthographic view illustrating one exemplary embodiment of a base portion wherein the base portion is configured for fixed engagement with an underwater floor.

FIG. 10 illustrates one exemplary embodiment of a base portion 130 of a post. The base portion 130 includes a threaded element 131. The threaded element 131 permits the base portion 130 to be driven into an underwater floor so that the base portion 130 is in fixed engagement with the underwater floor.

Figure 11:
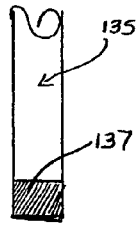
FIG. 11 is an orthographic view illustrating one exemplary embodiment of a base portion wherein the base portion is configured for stabilized engagement with an underwater floor.

FIG. 11 shows one exemplary embodiment of a base portion 135 of a post. The base portion 135 includes a weighted element 137. Operatively, the weighted element 137 enables the base portion 135 to be in stabilized engagement with the underwater floor. It should be emphasized that the weighted element 137 is composed of a material having a greater density than that of the base portion 135, such as a dense metal. Moreover, in this disclosure and appended claims the terms "stabilized engagement" or "maintain stability" refers to a post being in firm contact that is not likely to change on the underwater floor without toppling.

Figure 12:
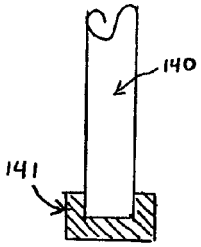
FIG. 12 is an orthographic view illustrating one exemplary embodiment of an end cap disposed on a base portion of a post.

FIG. 12 illustrates a base portion 140 of a post and an end cap 141 disposed on the base portion 140. In operation, the end cap 141 is provided to further enhance the post's contact with an underwater floor. In one exemplary embodiment, the end cap 141 is composed of a material for frictionally adhering to the underwater floor, such as a natural resin or a polymeric compound.

Figure 13:
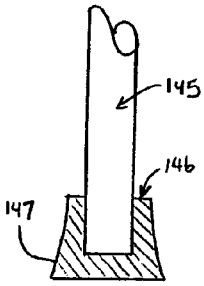
FIG. 13 is an orthographic view illustrating one exemplary embodiment of an end cap disposed on a base portion of a post, wherein the end cap is configured for stabilized engagement with an underwater floor.

FIG. 13 shows one exemplary embodiment of a base portion 145 of a post and an end cap 146 disposed on the base portion 145. The end cap 146 of FIG. 13 includes an outwardly curving wall 147. The outwardly curving wall 147 provides the end cap 146 with maximum surface area for contact with an underwater floor. In one exemplary embodiment, the end cap 146 is configured for stabilized engagement with an underwater floor.

Figure 14:
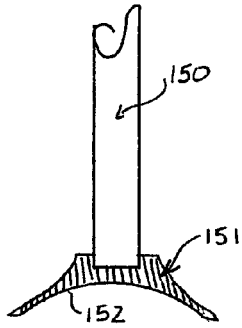
FIG. 14 is an orthographic view illustrating one exemplary embodiment of an end cap disposed on a base portion of a post, wherein the end cap is configured for stabilized engagement with an underwater floor.

FIG. 14 illustrates a base portion 150 of a post and an end cap 151 disposed on the base portion 150. The end cap 151 includes a vacuum suction member 152. Operatively, the vacuum suction member 152 permits the end cap 151 and, ultimately, the base portion 150 to adhere to an underwater floor. Thus, the end cap 151 is configured for stabilized engagement with an underwater floor.

Figure 15:
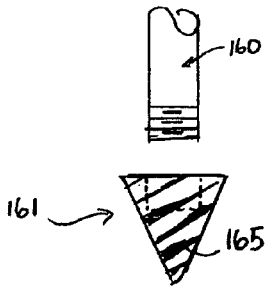
FIG. 15 is an orthographic view illustrating one exemplary embodiment of an end cap disposed on a base portion of a post, wherein the end cap is configured for fixed engagement with an underwater floor.

FIG. 15 shows a base portion 160 of a post and an end cap 161 disposed on the base portion 160. The end cap 161 includes threaded elements 165. The end cap 161 is configured for fixed engagement with an underwater floor. In one exemplary embodiment, the threaded elements 165 may form an Archimedes screw for engagement with an underwater floor.

Figure 16:
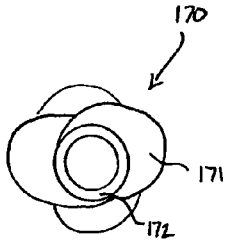
FIG. 16 is a top elevational view illustrating another exemplary embodiment of the end cap of FIG. 15.

FIG. 16 illustrates another exemplary embodiment of an end cap 170 similar to that of the end cap 161 of FIG. 15. Specifically, the end cap 170 of FIG. 16 includes large, paddle-like thread elements 171 radially extending from an annular base portion mount 172. The annular base portion mount 172 is configured for receiving a base portion of a post. The large, paddle-like thread elements 171 provide greater surface area for contact with the underwater floor thereby optimizing the end cap 170 for fixed engagement.

Figure 17:
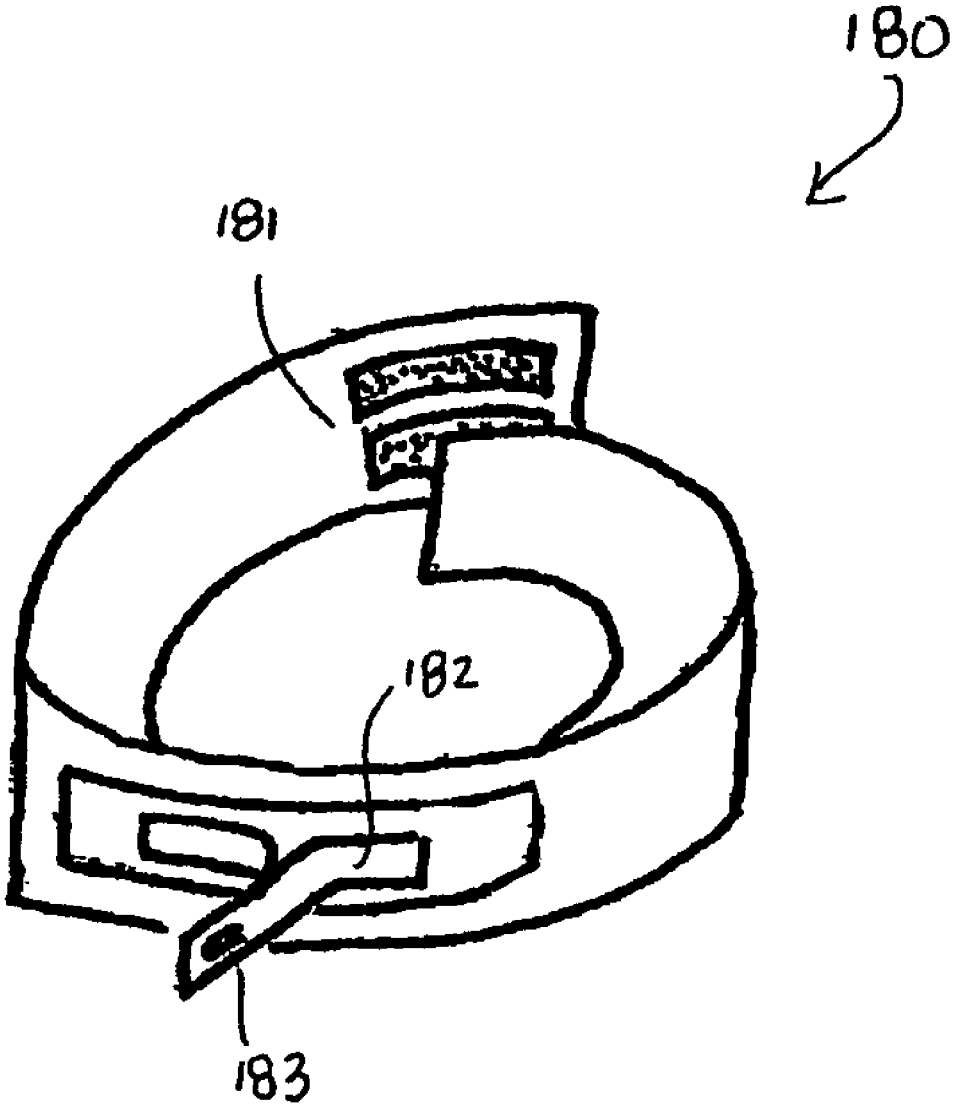
FIG. 17 is an isometric view illustrating one exemplary embodiment of a restraining belt for placement on a swimmer.

FIG. 17 illustrates one exemplary embodiment of a restraining belt 180. In one exemplary embodiment, the restraining belt 180 is composed of a resilient material, such as NEOPRENE.

The restraining belt 180 includes an adjustment assembly 181. The adjustment assembly 181 permits the restraining belt 180 to securely wrap around users of varying size. In one exemplary embodiment, the adjustment assembly 181 comprises a VELCRO clasp.

The restraining belt 180 further includes a tow anchor 182. As shown in FIG. 17, the tow anchor 182 extends outwardly from the restraining belt 180. The tow anchor includes a tether hitch 183. In operation, the tether hitch 183 securely receives at least one tether cord thereon. It should be added that in one exemplary embodiment the tow anchor 182 is at least in part composed of a resilient material. The resilient material is provided for accommodating shock forces delivered by a user while swimming.

Figure 18:
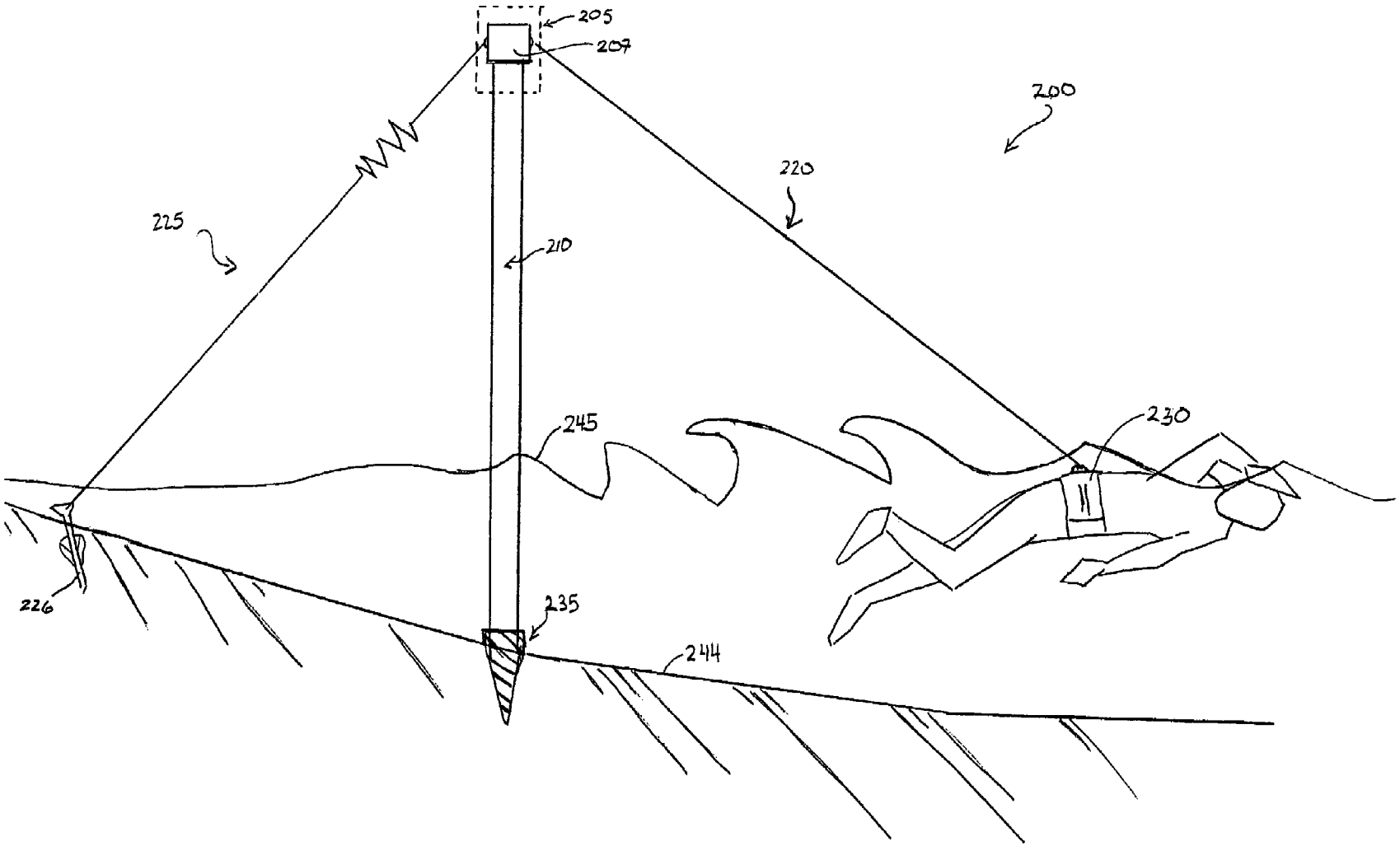
FIG. 18 is a side elevational view illustrating one exemplary embodiment of a stationary swimming device, the stationary swimming device is shown in fixed engagement with an underwater floor of a shore bed.

FIG. 18 illustrates a stationary swimming device 200. The stationary swimming device 200 is applied to keep a user in a fixed position while swimming within a body of water.

The stationary swimming device 200 includes a post 210. The post 210 includes tie portion 205. In operation, the tie portion 205 is positioned above a waterline 245. In particular, the tie portion 205 includes a hitch unit 207. Accordingly, a tether assembly 220 and an anchor assembly 225 are attached the hitch unit 207 to establish an angular relationship. The angular relationship supplies a compressive force through the post 210 to an underwater floor 244.

In one exemplary embodiment, the post 210 is constructed of a sufficient length to enable a swimmer to remain in a desired stationary position along the shore. Moreover, the post 210 of FIG. 18 is constructed from a single piece to provide maximum mechanical strength. In one exemplary embodiment, the post 210 may be composed of a resilient material.

As shown in FIG. 18, an end cap 235 is disposed on the post 210. Operatively, the end cap 235 provides fixed engagement with the underwater floor 244.

The stationary swimming device 200 further includes a restraining belt 230. The restraining belt 230 supplies a tension across the tether assembly 220. It should be added that the underwater floor 244 slopes downwardly from a beach (not shown). Accordingly, the underwater floor 244 shown in FIG. 18 is substantially parallel to the waterline 245.

Furthermore, the anchor assembly 225 of FIG. 18 includes an anchor 226. It should also be added that, operatively, anchor 226 may be partially or completely submerged below the waterline 245.

Figure 19:
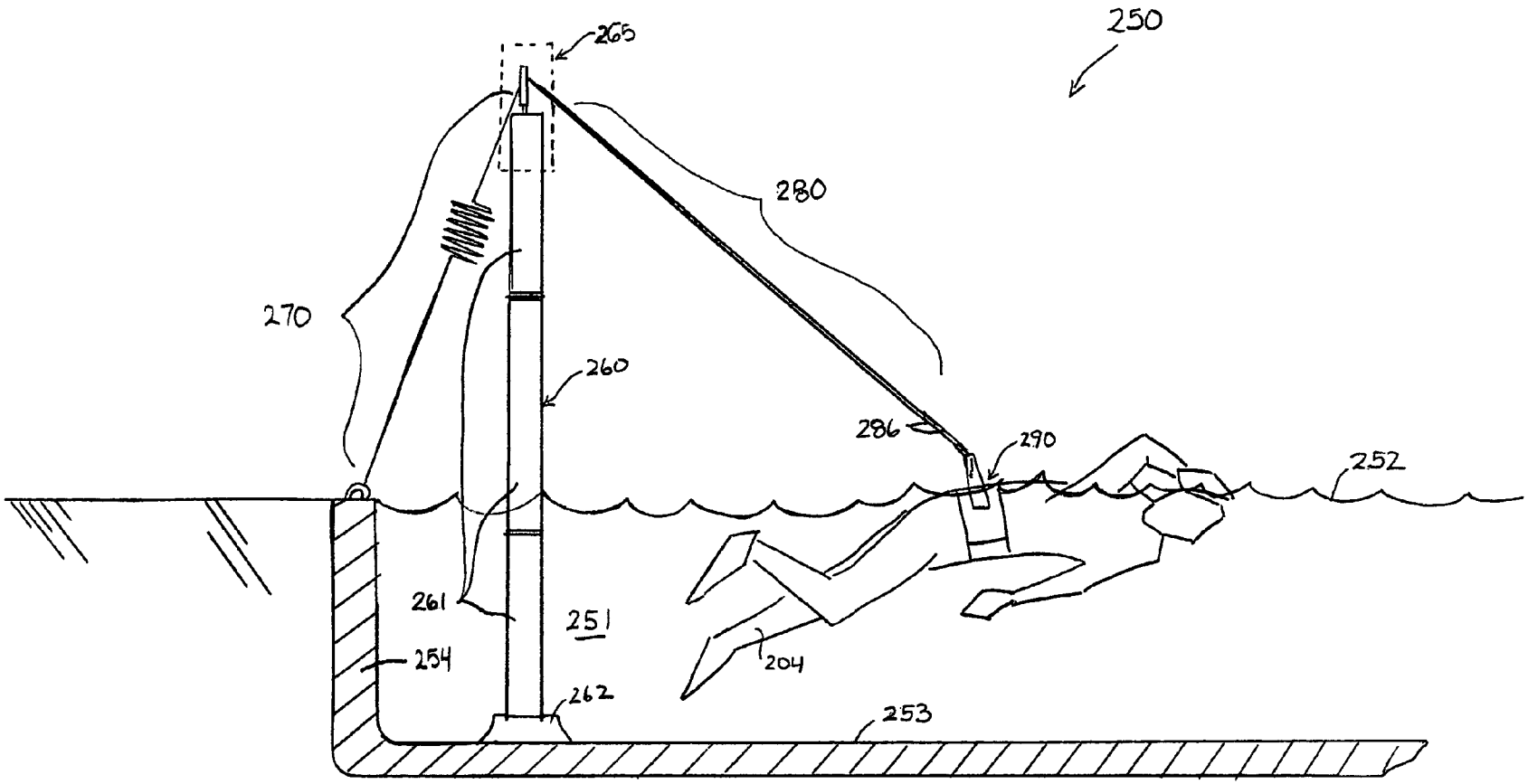
FIG. 19 is a side elevational view illustrating one exemplary embodiment a stationary swimming device, the stationary swimming device includes an end cap for frictionally adhering to an underwater floor.

FIG. 19 illustrates a stationary swimming device 250. The stationary swimming device 250 fixates a user's 204 location within a body of water 251 while swimming. Specifically, in FIG. 19, the body of water 251 comprises a man-made pool.

The stationary swimming device 250 includes a post 260. The post 260 is positioned longitudinally on an underwater floor 253. As shown in FIG. 19, the underwater floor 253 is parallel to a top surface 252 of the body of water 251. In one exemplary embodiment, the post 260 is formed by a plurality of segments 261.

The post 260 further includes a tie portion 265. The tie portion 265 is positioned above the top surface 252.

The tie portion 265 is coupled to an anchor assembly 270 and a tether assembly 280. The tether assembly 280 of FIG. 19 includes a plurality of tether cords 286. Accordingly, the plurality of tether cords 286 are each coupled to a restraining belt 290. In FIG. 19, the anchor assembly 270 is secured to a vertical wall 254. The vertical wall 254 is positioned perpendicular to the underwater floor 253.

In operation, the user 204 supplies a tension from the restraining belt 290 across the tether assembly 280 to the tie portion 265 of the post 260. The tension ensures an angular relationship between the tether assembly 280 and the anchor assembly 270 relative to the tie portion 265. As such, the angular relationship maintains the post 260 in a longitudinal position within the body of water 251 and in stable contact with the underwater floor 253.

The stationary swimming device 250 includes an end cap 262. In operation, the end cap 262 is disposed on the post 260 and remains in contact with the underwater floor 253. In one exemplary embodiment, the stationary swimming device 250 is configured for stabilized engagement with the underwater floor 253.

Figure 20:
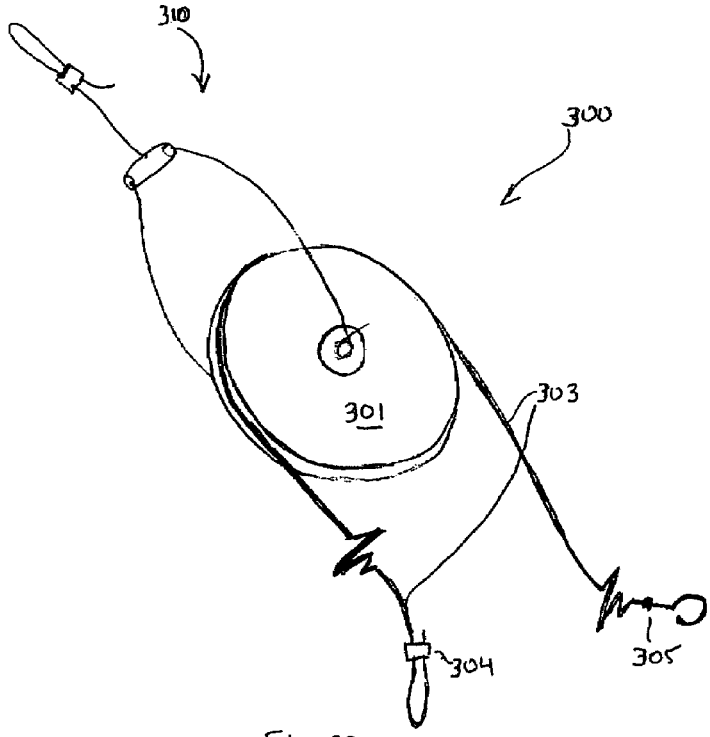
FIG. 20 is a schematic view illustrating one exemplary embodiment of a tether assembly of a stationary swimming device.

FIG. 20 illustrates one exemplary embodiment of a tether assembly 300 for a stationary swimming device of this disclosure and appended claims. The tether assembly 300 includes a pulley 301. A tether cord 303 is drawn across the pulley 301. Accordingly, each end of the tether cord 303 is secured to a restraining belt (not shown).

The tether assembly 300 further includes a pulley assembly 310 coupled to the pulley 301. The pulley assembly 310 is further coupled to a tie portion of a post thereby securing the pulley 301 to the tie portion. In operation, the pulley 301 of the tether assembly 300 accommodates side-to-side movement exerted by a swimmer.

Figure 21:
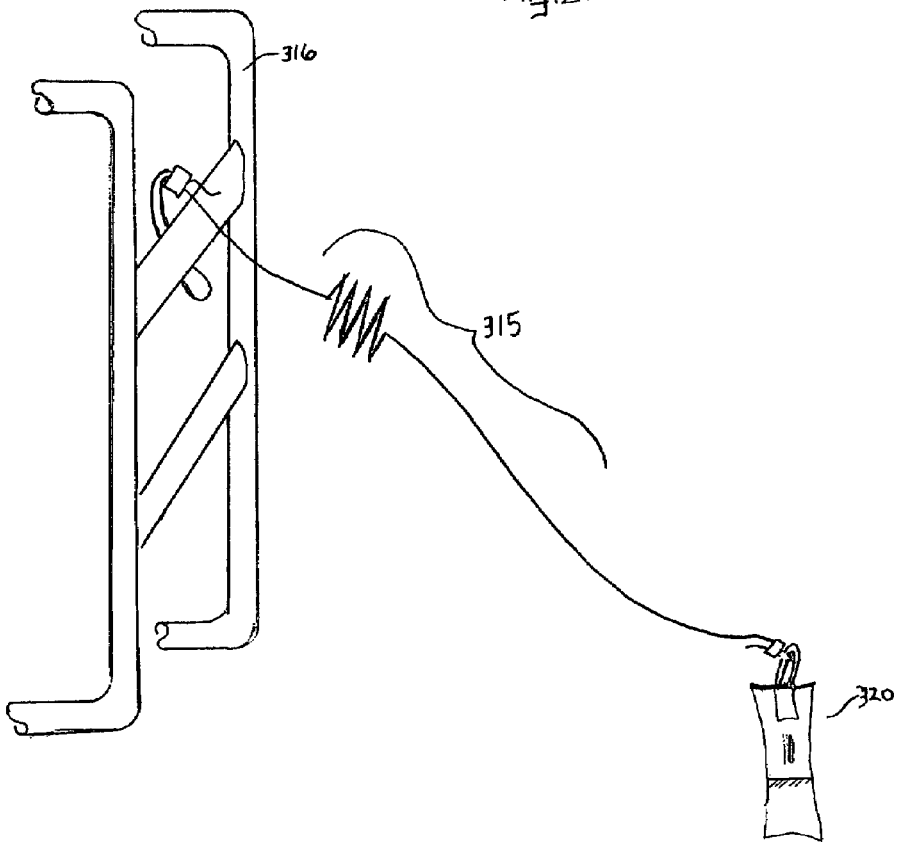
FIG. 21 is a schematic view illustrating one exemplary embodiment of an anchor assembly of a stationary swimming device.

FIG. 21 illustrates one exemplary embodiment of an anchor assembly 315 for a stationary swimming device of this disclosure and appended claims. The anchor assembly 315 of FIG. 21 is released from a post, especially in a situation where a body of water becomes too deep to maintain the post a longitudinal position. Accordingly, the anchor assembly 315 may be coupled to a restraining belt 320 and to an anchor member 316. FIG. 21 shows the anchor member 316 comprising the railing from a passenger boat that is located offshore.

Figure 22:
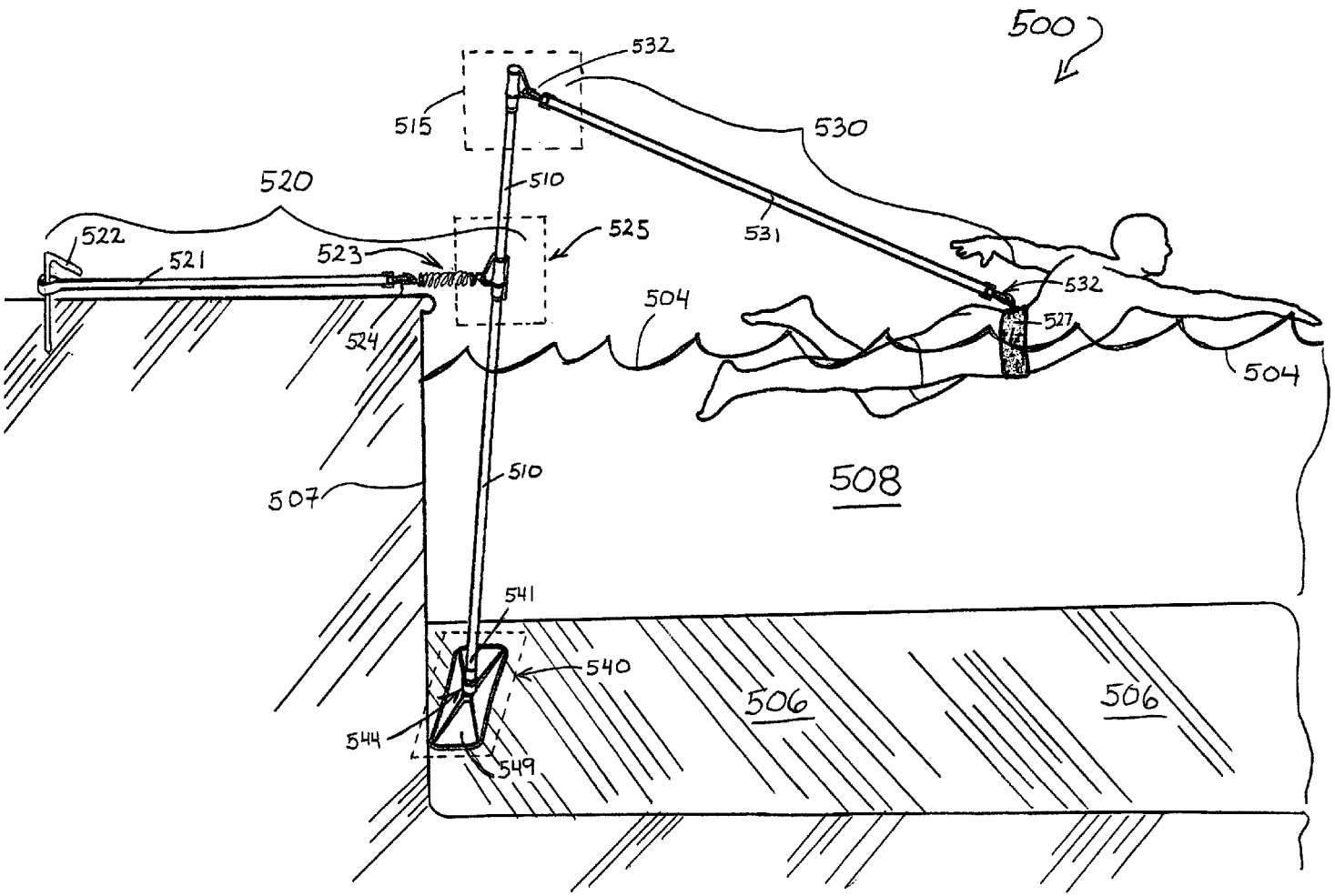
FIG. 22 is a side elevational view illustrating one exemplary embodiment of a stationary swimming device, the stationary swimming device includes a slideable anchoring collar coupled to a post to maintain stability of the post within a body of water as a tethered swimmer applies a variable force to the post.

FIG. 22 illustrates one exemplary embodiment of a device 500 for restraining a user while swimming in a body of water 508. The body of water 508 is positioned on an underwater floor 506 and defines a top surface 504. Illustratively, the device 500 may be applied to a variety of settings such as an underwater floor for a natural or man-made pool (as shown in FIG. 22), along the shoreline of a costal bed, lake bed, river bed, and stream bed.

Similar to the embodiments provided above, the device 500 includes a post 510 as well as a tether assembly 530 and anchor assembly 520 each coupled to the post 510. In operation, a user applies a variable tension across the tether assembly 530 to the post 510 while swimming. Moreover, the anchor assembly 520 supplies a tensile force to the post 510 to counteract the swimmer's variable tension and to maintain the post 510 in continuous contact with the underwater floor 506 and in either a longitudinal or a substantially longitudinal position within the body of water 508. The post 510 defines a base portion 541 for continuous contact with the underwater floor 506.

The post 510 may be constructed of a single piece member. A post composed of a single piece member provides greater mechanical strength to the device 500 than a post composed of many segments.

In one exemplary embodiment, the post 510 may be composed of a plurality of segments. In one exemplary embodiment, at least one segment of the plurality of segments locks in position. Operatively, the post 510 may be composed of a plurality of segments that account for variations in the overall length of the post 510. Those of ordinary skill in the art will readily recognize any suitable number of segments for positioning a portion of the post 510 above the top surface 504 of the body of water 508.

The device 500 further includes a tie portion 515 coupled to the post 510. As shown in FIG. 22, the tie portion 515 is positioned on a distal end of the post 510 and above the top surface 504 of the body of water 508. In one exemplary embodiment, the post 510 defines the tie portion 515. In operation, the tether assembly 530 is coupled to the tie portion 515 as a swimmer applies a tension across the tether assembly 530.

The tether assembly 530 includes at least one tether cord 531. The at least one tether cord 531 is coupled to the tie portion 515. In one exemplary embodiment, the tether assembly 530 includes a plurality of tether cords.

The tether assembly 530 includes at least one tether cord fastener 532 distally positioned at one end of the tether cord 531. As shown in FIG. 22, the tether cord fastener 532 couples the tether cord 531 to the swimmer. Moreover, for the embodiment of FIG. 22, the tether cord fastener 532 couples the tether cord 531 to the tie portion 515.

In one exemplary embodiment, the tether cord fastener 532 is configured to be releasable from the swimmer and the tie portion 515. In one exemplary embodiment, the tether cord fastener 532 is pivotally coupled to the swimmer. In one exemplary embodiment, the tether cord fastener 532 is pivotally coupled to the tie portion 515 disposed on the post 510.

Similar to the restraining belts described in the above embodiments, the device 500 further includes a restraining belt 533. In one exemplary embodiment, the restraining belt 533 is composed of a resilient material, such as NEOPRENE.

As shown in FIG. 22, the restraining belt 533 is positioned on the user while swimming through the body of water 508.

Particularly, the at least one tether cord 531 is coupled to both the tie portion 515 and the restraining belt 533.

Similar to embodiments presented above, the restraining belt 533 includes a tow anchor extending outwardly from the restraining belt 533 and for receiving the tether cord fastener 532. The tow anchor is at least in part composed of a resilient material for accommodating shock forces delivered by a user while swimming.

Figure 24:
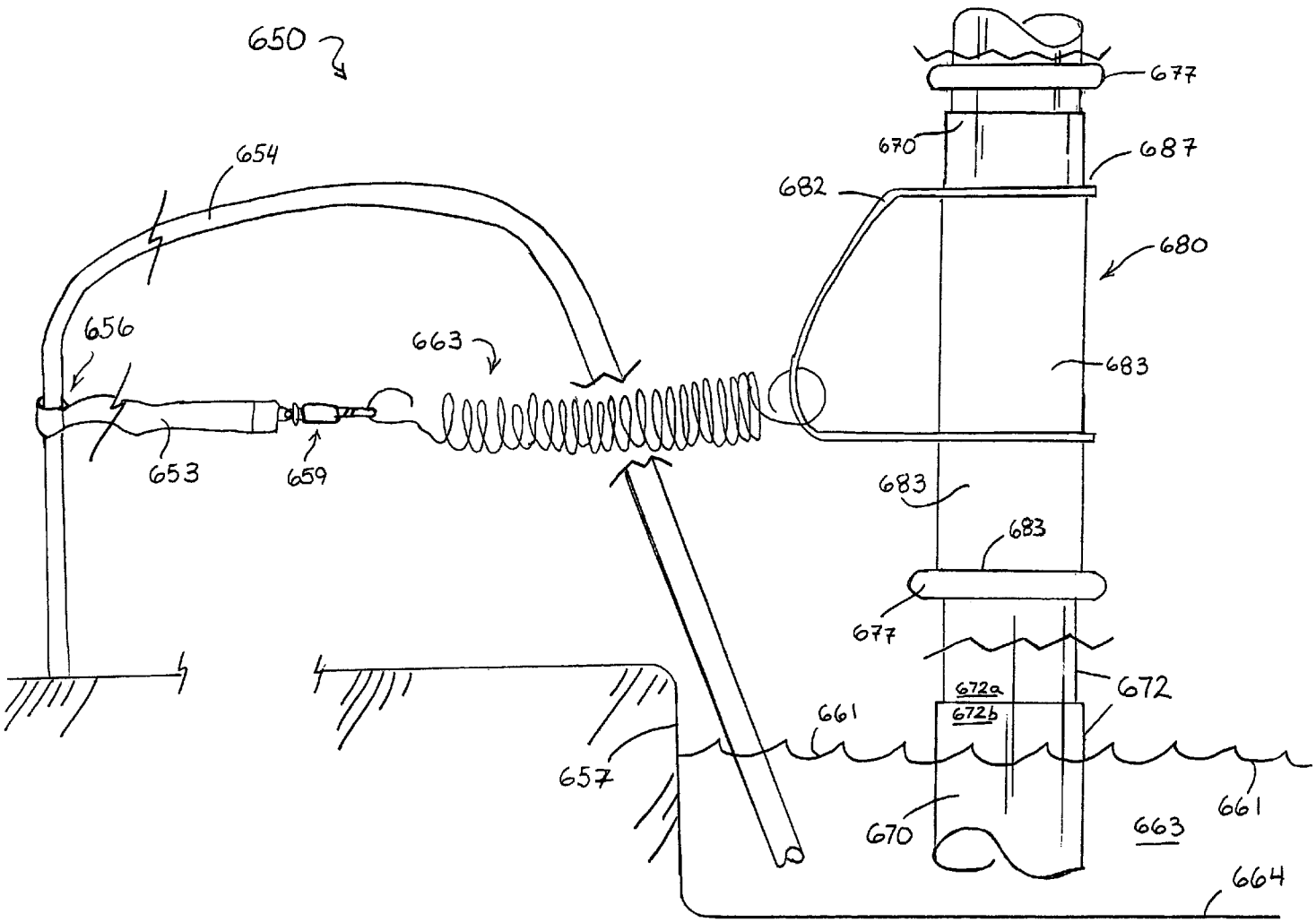
FIG. 24 is a schematic view illustrating one exemplary embodiment of an anchor assembly of a stationary swimming device of FIG. 22 featuring an anchoring collar.

The anchor assembly 520 of the device 500 includes an anchor 522. As shown in FIG. 22, the anchor 522 is in secured engagement to a surrounding environment adjacent to the underwater floor 506. In one exemplary embodiment, the anchor 522 comprises a stake driven into a substrate located adjacent to the pool that defines the underwater floor 506. In one exemplary embodiment, as shown in FIG. 24, the anchor may comprise railing secured around the perimeter of a pool, a passenger boat or the dock near a body of water.

In one exemplary embodiment, an anchor may be secured to the underwater floor 506. Illustratively, FIG. 18 shows an anchor secured to an underwater floor.

The anchor assembly 520 further includes at least one anchor cord 521. In one exemplary embodiment, the anchor assembly 520 may include a plurality of anchor cords. The at least one anchor cord 521 is positioned between the anchor 522 and the post 510. In operation, the secured anchor 522 provides a tension across the anchor cord 521 to the post 510 to counteract tensile forces applied to the post 510 by the tether assembly 530. In one exemplary embodiment, the anchor assembly 520 is configured to be releaseable from the post 510.

In one exemplary embodiment, the anchor assembly 520 may further include a damper 523. The damper 523 is coupled in line with the anchor cord 521. In one exemplary embodiment, a damper fastener 524 is provided at one end of the damper 523 to releasably couple the damper 523 to the anchor cord 521. Optionally, the damper fastener 524 may pivotally couple the damper 523 to the anchor cord 521. In operation, the damper 522 dissipates any shock forces exerted by the user as the user continuously pulls against the tether assembly 521 and post 510 while swimming.

For the embodiment of FIG. 22, the anchor assembly 520 further includes an anchoring collar 525. As shown, the anchor cord 521 is coupled to the anchoring collar 525 at one end and is fixedly secured at another end, via the anchor 522.

As discussed in greater detail below in reference to FIGS. 23-24, the anchoring collar 525 features a fastening interface for receiving a damper or, optionally, an anchor cord. The anchoring collar 525 further includes a collar bore configured to conform to and slide about the other surface of the post 510.

In operation, as the tether assembly 530 supplies the variable force to the post 510 exerted by the user, the anchoring collar 525 supplies a counteracting tensile force to the post 510 to maintain stability of the post 510 within the body of water 508. In particular, the tensile forces from the anchoring collar 525 and the tether assembly 530 provide a downward compressive force through the post 510 to the underwater floor 506.

Moreover, as the user applies a variable force in variable directions to the post 510, the anchoring collar 525 slides along the post 510. Therefore, while in sliding engagement with the post 510, the anchoring collar 525 provides a tensile force to the post 510 to counteract the swimmer's variable tension and to maintain the post 510 both in a longitudinal position within the body of water 508 and in continuous contact with the underwater floor 506.

It should be mentioned that the tensile force generated by the swimmer is oriented along the top surface 504 and thus creates a tension along the tether cord 531 from the tie portion 515 to the swimmer. Accordingly, the anchoring collar 525 permits the anchoring assembly 520 to position itself along the post 510 to best counteract the swimmer's force. In effect, the anchoring collar 525 permits the anchoring assembly 520 it align nearest to the origin of the swimmer's force, i.e. the top surface 504.

Illustratively, as shown in FIG. 22, a containment wall 507 adjacent to the body of water 508 extends above the top surface 504. The anchoring collar 525 permits the anchor assembly 520 to slide in position with the post 510 closest to the top surface 504. As discussed in greater detail below, the device 500 may include at least one retainment ring disposed on the post and in contact with the anchoring collar. As the anchoring collar ultimately tends to align with the opposing force generated by the swimmer along the top surface 504, the retainment ring stops sliding movement of the anchoring collar 525 along the post past 510 the retainment ring.

The device further includes a base assembly 540. As shown in FIG. 22, the base assembly 540 is coupled to the post 510. In one exemplary embodiment, the base assembly 540 is releasably coupled to the post 510.

The base assembly 540 includes a base element 549 and a swivel coupling arrangement 544 coupled to the base element 549 and the base portion 541 of the post 510. The base element 549 features a top portion and a bottom portion where the bottom portion is positioned on the underwater floor 506. In operation, as discussed in greater detail below, the swivel coupling arrangement 544 enables the post 510 to pivot in the direction of the tensile force applied by the tethered swimmer as the base element 549 maintains contact with the underwater floor Referring to FIG. 22, a method for restraining a user while swimming in a body of water may be appreciated. In operation, the restraining belt 527 is positioned on the user. The restraining belt 527 is coupled to the stationary swimming device 500.

As such, the post 510 is positioned longitudinally within the body of water 508 and in contact with the underwater floor 506 where the underwater floor 506 is parallel with the top surface 504. In one exemplary embodiment, the post 510 is positioned substantially longitudinally within the body of water 508 and in contact with the underwater floor 506 where the underwater floor 506 is parallel with the top surface 504. Optionally, the step of positioning the post 510 longitudinally may include the step of adjusting telescoping segments of the post 510 to a length extending above the top surface 504 of the body of water 508.

Optionally, the step of positioning the post 510 longitudinally may further include the step of pivotally coupling the post 510 to a base assembly 540 and pivotally directing the post 510 with respect to the direction of the variable tensile force exerted on the post 510 by the user. The base assembly 540 may be released from the post 510.

A portion of the anchor assembly 520 is secured via the anchor 522 and a tension is thus supplied across the anchor assembly 520. The swimmer supplies a variable tensile force from the restraining belt 527 across the tether assembly 530 to the tie portion 515. The anchoring collar 525 supplies a counteracting tensile force to the post 510. As the tether assembly 530 supplies a variable tensile force to the post 510 exerted by the user and the anchor assembly 520 supplies the counteracting force, the balance of forces maintains the longitudinal stability of the post 510 within the body of water 508. A retainment ring may be inserted on the post to stop sliding movement of the anchoring collar 525 along the post 510 past the retainment ring.

Figure 23:
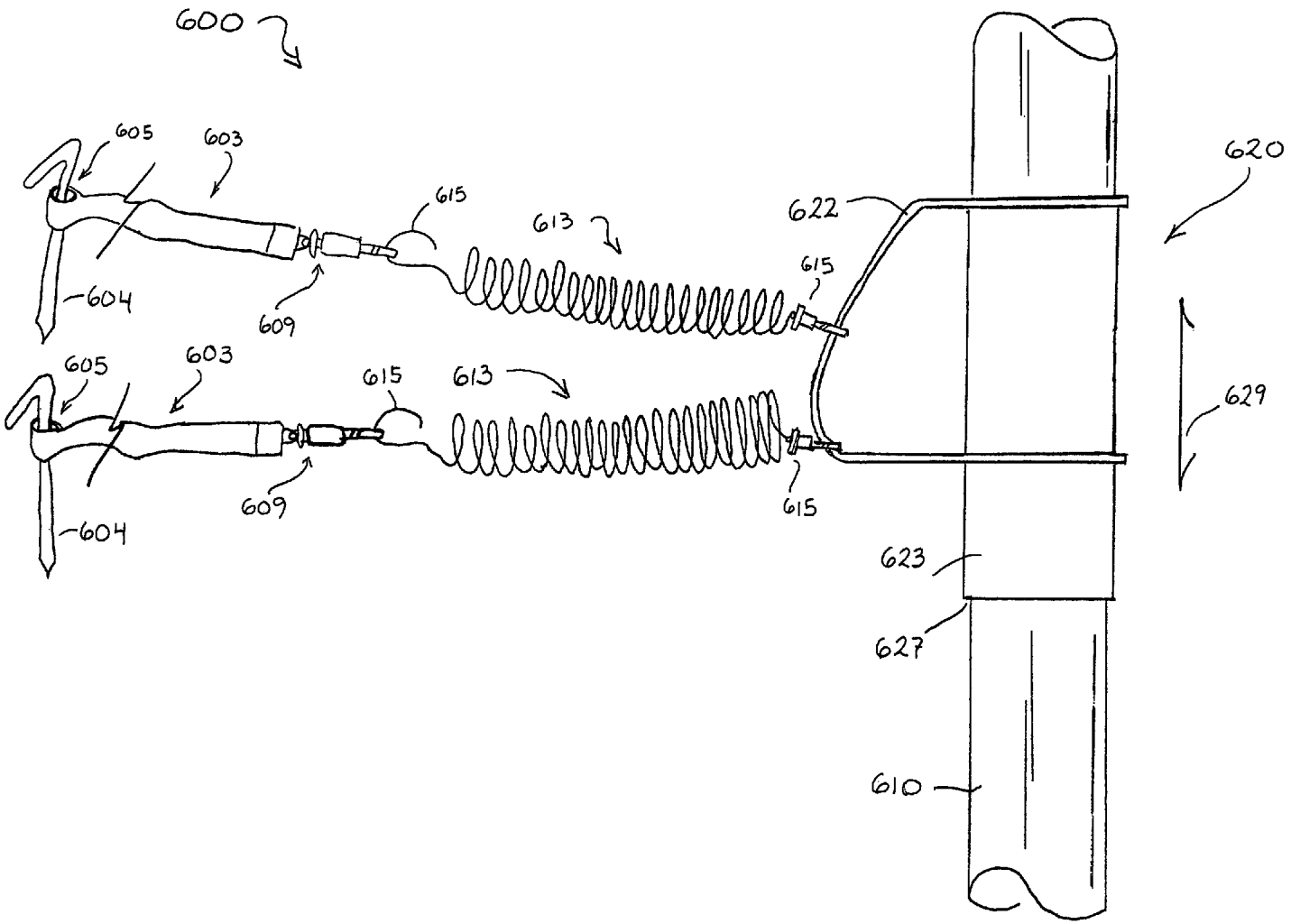
FIG. 23 is a schematic view illustrating one exemplary embodiment of an anchor assembly of the stationary swimming device of FIG. 22 featuring an anchoring collar.

FIG. 23 is a schematic view illustrating one exemplary embodiment of an anchor assembly 600 of the stationary swimming device 500 of FIG. 22. The anchor assembly 600 includes at least one anchor 604 and at least one anchor cord 603. The anchor cord 603 is secured to the anchor 604 with an anchor fastener 605 of a type well known in the art, such as a loop as shown. For the embodiment of FIG. 23, the anchor assembly 600 provides a plurality of anchor cords 603.

In operation, the at least one anchor cord 603 is positioned between the anchor 604 and the post 610. In operation, the secured anchor 604 provides a tension across the anchor cord 603 to the post 610 to counteract tensile forces applied to the post 610 by a tether assembly (not shown).

For the embodiment of FIG. 23, the anchor assembly 600 includes an anchor assembly fastener 609. Operatively, the anchor assembly fastener 609 pivotally couples the anchor cord 603 to the post 610 and is releasable therefrom.

In one exemplary embodiment, the anchor assembly 600 may further include at least one damper 613. The damper 613 is coupled in line with the anchor cord 603. For the embodiment of FIG. 23, the anchor assembly 600 provides a plurality of dampers 613.

In one exemplary embodiment, a damper fastener 615 is provided at one end of the damper 613 to releasably couple the damper 613 to the anchor cord 603. For the embodiment of FIG. 23 a damper fastener 615 is provided at one end of the damper to releasably couple the damper 613 to the anchor cord 603. Optionally, the damper fastener 615 may pivotally couple the damper 613 to the anchor cord 603 and to an anchoring collar 620 at another end. In operation, the damper 613 dissipates any shock forces exerted by the user as the user continuously pulls against a tether assembly and the post 610 while swimming.

The anchoring assembly 600 further includes an anchoring collar 620. The anchoring collar 620 features a collar body 623. The collar body 623 is characteristically rigid and may be composed of either a polymeric or metallic material.

As shown in FIG. 23, the collar body 623 defines a collar bore 627. In one exemplary embodiment, the collar bore 627 extends through the entire collar body 623. The collar bore 627 configured to conform to and slide about the outer surface of the post 610.

In operation, as a swimmer applies a variable force in variable directions to the post 610, the anchoring collar 620 is in sliding engagement with the post 610. FIG. 23 features a collar slide axis 629 that shows the direction that the anchoring collar slides on the post 610. While in sliding engagement with the post 610, the anchoring collar 620 provides a tensile force to the post 610 to counteract the swimmer's variable tension. Moreover, the counteracting tensile forces from the anchoring collar 620 and the swimmer, via a tether assembly, provide a downward compressive force through the post 610 to the underwater floor 506. Therefore, the anchoring collar 627 helps to maintain the post 610 both in a longitudinal position within the body of water 508 and in continuous contact with the underwater floor 506.

The anchor assembly 600 further includes a fastening interface 622. In one exemplary embodiment, the fastening interface 622 is integral with the collar body 623. As shown in FIG. 23, the fastening interface 622 extends outwardly from the collar body 623. In operation, the fastening interface 622 securely receives the damper 613 or, optionally, the anchor cord 603 to thereby establish a tension across the anchor assembly 600 between the anchor 604 and the collar body 623.

FIG. 24 is a schematic view illustrating one exemplary embodiment of an anchor assembly 650 of the stationary swimming device 500 of FIG. 22. The anchor assembly 650 applies a tension to a post 670. As shown in FIG. 24, the post 670 may be constructed of a plurality of segments 672. The plurality of segments 672 may lock in position so as to ensure that a desired length is maintained for the post 670. In one aspect, the post 670, in whole or in part, may be constructed of telescoping segments 672*a*, 672*b* for selectively adjusting overall length of the post 670. Those of ordinary skill in the art will readily recognize any suitable number of segments for positioning a tie portion (not shown) and at least a portion of the post 670 above the top surface 661 so as to permit the user to swim away from the post at any desired distance.

The anchor assembly 650 includes an anchor 654. The anchor 654 is secured to a surrounding environment 657 adjacent to an underwater floor 664. Illustratively, for the embodiment of FIG. 24, the anchor 604 comprises railing secured around the perimeter of a pool, a passenger boat or the dock near a body of water.

The anchor assembly 650 further includes at least one anchor cord 653. The anchor cord 653 is secured to the anchor 654 with an anchor fastener 656 of a type well known in the art, such as a loop as shown.

In operation, the at least one anchor cord 653 is positioned between the anchor 654 and the post 670. In operation, the secured anchor 654 provides a tension across the anchor cord 653 to the post 670 to counteract tensile forces applied to the post 670 by a tether assembly (not shown).

In one exemplary embodiment, the anchor assembly 650 may further include at least one damper 663. The at least one damper 663 is coupled in line with the anchor cord 653. In operation, the damper 663 dissipates any shock forces exerted by the user as the user continuously pulls against a tether assembly and the post 670 while swimming.

For the embodiment of FIG. 24, the anchor assembly 600 includes an anchor assembly fastener 659. Operatively, the anchor assembly fastener 659 pivotally couples the anchor cord 653 to the damper 610 and is releasable therefrom so as to alternatively couple to the anchoring collar 680 without the damper 610.

The anchoring assembly 650 further includes an anchoring collar 680. The anchoring collar 680 features a collar body 683. The collar body 683 is characteristically rigid and may be composed of either a polymeric or metallic material.

As shown in FIG. 24, the collar body 683 defines a collar bore 688. In one exemplary embodiment, the collar bore 688 extends through the entire collar body 683. The collar bore 688 is configured to conform to and slide about the other surface of the post 670.

The anchor assembly 650 further includes a fastening interface 682. In one exemplary embodiment, the fastening interface 682 is integral with the collar body 683. As shown in FIG. 24, the fastening interface 682 extends outwardly from the collar body 683. In operation, the fastening interface 682 securely receives the damper 663 or, optionally, the anchor cord 653 to thereby establish a tension across the anchor assembly 650 between the anchor 654 and the collar body 683.

In operation, as a swimmer applies a variable force in variable directions to the post 670, the anchoring collar 680 is in sliding engagement with the post 670. While in sliding engagement with the post 670, the anchoring collar 680 provides a tensile force to the post 670 to counteract the swimmer's variable tension. The counteracting tensile forces from the anchoring collar 680 and the swimmer, via a tether assembly, collectively provide a downward compressive force through the post 670 to the underwater floor 664. Therefore, the anchoring collar 680 helps to maintain the post 670 both in a longitudinal position within the body of water 663 and in continuous contact with the underwater floor 664.

It should be mentioned that the tensile force generated by the swimmer originates along the top surface 661 of the body of water 663 and thus creates a tension along a tether assembly to the swimmer. Accordingly, the anchoring collar 680 permits the entire anchoring assembly 650 to interactively reposition itself along the post 670 to best counteract the swimmer's variable force. In effect, the anchoring collar 680 permits the anchoring assembly 650 to align nearest to the origin of the swimmer's force, such as the top surface 661.

Illustratively, as shown in FIG. 24, the surrounding environment 657 is adjacent to the body of water and extends above the top surface 661. The anchoring collar 680 permits the entire anchor assembly 650 to slide along the post 670 in a position closest to the origin of the swimmer's force, such as the top surface 661.

For the embodiment of FIG. 24, the anchor assembly 650 may include at least one retainment ring 677 disposed on the post 670. Operatively, the retainment ring 677 is inserted on the post 670 to stop sliding movement of the anchoring collar 680 along the post 670 past the retainment ring 677. While in contact with the anchoring collar 680, the retainment ring 677 stops further movement of the entire anchor assembly 650 along the post 670 past the retainment ring 677 as the anchoring collar 680 ultimately tends to align with the plane of opposing force generated by the swimmer along the top surface 661. As shown in FIG. 24, retainment rings 677 may be placed on the post 670 above and below the anchoring collar 680 to restrict movement of the anchoring collar 680 along the post 670.

Figure 25:
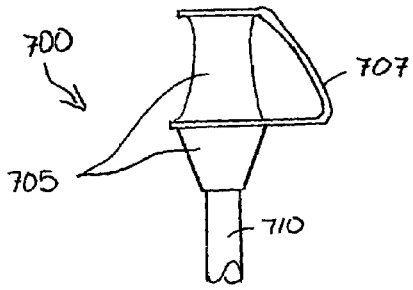
FIG. 25 is an orthographic view illustrating one exemplary embodiment of a tie portion coupled to a post for the stationary swimming device of FIG. 22.

FIG. 25 illustrates one exemplary embodiment of a tie portion 700 of the stationary swimming device 500 of FIG. 22. In one exemplary embodiment, the tie portion 700 is coupled to a post 710. Those of ordinary skill in the art will readily recognize any suitable means for securing the tie portion 700 to the post 710. In one exemplary embodiment, the post 710 defines the tie portion 700 so that the post 710 and tie portion 700 are an integral piece.

The tie portion 700 includes a tie portion body 705. The tie portion 700 further includes a fastening interface 707. In one exemplary embodiment, the fastening interface 707 is integral with the tie portion body 705. As shown in FIG. 23, the fastening interface 707 extends outwardly from the tie portion body 705. In operation, the fastening interface 707 securely receives a tether cord of a tether assembly (not shown) to thereby establish a tension across the tether assembly between a swimmer's restraining belt and the tie portion body 705.

Figure 26:
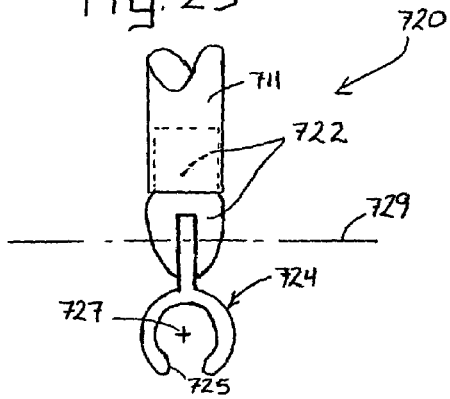
FIG. 26 is an orthographic view illustrating one exemplary embodiment of a swivel coupling arrangement of a stationary swimming device of FIG. 22, the swivel coupling arrangement enables a pole to pivot in the direction of tensile force applied by the tethered swimmer.

FIG. 26 illustrates one exemplary embodiment of a swivel coupling arrangement 720 of a stationary swimming device of FIG. 22. The swivel coupling arrangement 720 is coupled to a base portion 711 of a post and to a base assembly (not shown). The swivel coupling arrangement 720 enables a post to pivot in the direction of tensile force applied by a tethered swimmer. In effect, the swivel coupling arrangement 720 facilitates ease of use by allowing the post to move in the direction of the swimmer at all times while ensuring continuous contact of the post with an underwater floor. In one exemplary embodiment, the swivel coupling arrangement 720 enables the post to be releaseably coupled to the base assembly.

In one exemplary embodiment, the swivel coupling arrangement 720 includes a swivel body 722 and a stem body 724 coupled to the swivel body 722. The swivel body 722 is characteristically rigid and may be composed of either a polymeric or metallic material. In one exemplary embodiment, the swivel body 722 may be composed of a weighted material for stabilizing the base portion 711 with respect to an underwater floor.

The swivel body 722 is fixed to the base portion 711 of the post. Those of ordinary skill in the art will readily recognize any suitable means for securing the swivel body 722 to the post.

The stem body 724 joins with the swivel body 722 to define a first rotational axis 729 for the post. Operatively, the swivel coupling arrangement 720 permits the base portion 711 and the entire post to rotate about the first rotational axis 729 as the tethered user swims in a variety of directions relative to the first rotational axis 729. Those of ordinary skill in the art will readily recognize any suitable means for joining the stem and swivel bodies 724, 722 that facilitates rotation about the first rotational axis 729, such as a pin or dowel-type interface.

As shown in FIG. 26, the stem body 724 defines a stem end portion 725. The stem end portion 725 is configured for coupling with a base element, as discussed in greater detail below, and thus defining a second rotational axis 727 for the post. Operatively, the swivel coupling arrangement 720 permits the base portion 711 and the entire post to rotate about the second rotational axis 727. Those of ordinary skill in the art will readily recognize any suitable means for joining the stem end portion 725 and base element that facilitate rotation about the second rotational axis 727, such as a pin and shackle interface shown in FIG. 26.

In short, for the embodiment of FIG. 26, the swivel coupling arrangement 720 ultimately permits the post to simultaneously move about a first and second rotational axis, 729, 727 as the tethered user swims in a variety of directions relative to the swivel coupling arrangement 720. Those of ordinary skill in the art will readily recognize any suitable coupling arrangement for a post and base assembly that provides one or a plurality of rotational axes for permitting the post to correspondingly move with the tethered user while swimming in a variety of directions relative to the coupling arrangement.

Figure 27:
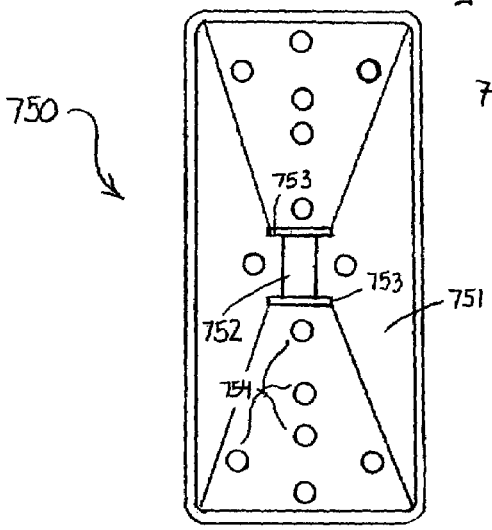
FIG. 27 is an orthographic view illustrating one exemplary embodiment of a top portion of a base element of the stationary swimming device of FIG. 22.

FIG. 27 illustrates one exemplary embodiment of a top portion of a base element 750 whereas the base element is a component of the base assembly of FIG. 22. As shown, top portion 750 includes a base body 751. The base body 751 is characteristically rigid and may be composed of either a polymeric or metallic material. In one exemplary embodiment, the base body 751 may be composed of a weighted material for stabilizing the base element with respect to an underwater floor.

The top portion 750 further includes a base anchor 752. The base anchor 752 is secured to the top portion 750 to form an integral piece. In one exemplary embodiment, the base body 751 defines the base anchor 752. For the embodiment of FIG. 27, the base body 751 defines guide walls 753 that abut and support the base anchor 752 therebetween. Operatively, a stem end portion from a swivel coupling arrangement is secured to the base anchor 752 to define a rotational axis for the post.

For the embodiment of FIG. 27, the top portion includes a plurality of grip portion anchors 754. The plurality grip portion anchors 754 are secured to the base body 751 and support a plurality of grip portions provided on the bottom portion of a base element as shown in FIG. 28.

Figure 28:
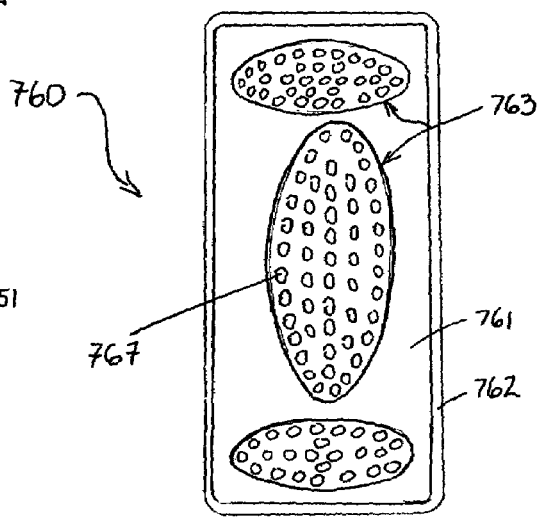
FIG. 28 is an orthographic view illustrating one exemplary embodiment of a bottom portion of a base element of the stationary swimming device of FIG. 22.

FIG. 28 illustrates one exemplary embodiment of a bottom portion of a base element 760 whereas the base element is a component of the base assembly of FIG. 22. As shown, bottom portion 760 includes a base body 761. The base body 761 is characteristically rigid and may be composed of either a polymeric or metallic material. In one exemplary embodiment, the base body 761 may be composed of a weighted material for stabilizing the base element with respect to an underwater floor.

In one exemplary embodiment, the base body 761 defines a raised surface 762. For the embodiment of FIG. 28, the raised surface 762 is formed about the outer perimeter of the base body 761. In operation, the raised surface promotes frictional contact of the bottom portion 760 with the underwater floor. Those of ordinary skill in the art will readily recognize a wide variety of configurations for the raised surface 762 to promote frictional contact with the underwater floor.

In one exemplary embodiment, the base element 760 includes a plurality of grip portions 763. For the embodiment of FIG. 28, a stabilized position of a post within a body of water is frictionally maintained, at least in part, by the plurality of grip portions 763.

For the embodiment of FIG. 28, the plurality of grip portions 763 comprise rubber or plastic grips featuring a multiplicity of gripping nodules 767 protruding outwardly from the base body 761. In effect, the gripping nodules 767 provide added surface area for frictional engagement with the underwater floor. In operation, the plurality of grip portions 763 are configured for stabilized engagement with the underwater floor. Those of ordinary skill in the art will readily recognize any suitable means for allowing the bottom portion of the base element 760 maintain a stabilized engagement with the underwater floor.

In one exemplary embodiment, the plurality of grip portions 763 comprise rubber or plastic suction cups protruding outwardly from the base body 761. In operation, the plurality of grip portions 763 are configured for fixed engagement with the underwater floor. Those of ordinary skill in the art will readily recognize any suitable means for allowing the bottom portion of the base element 670 maintain a fixed engagement with the underwater floor.

In one exemplary embodiment, as grip portions are not provided, the base body 761 is composed at least in part of a material for stabilized engagement with the underwater floor. In one exemplary embodiment, as grip portions are not provided, the base body 761 is composed at least in part of a material for fixed engagement with the underwater floor.

Although the present invention has been described in detail, it should be understood that various changes, substitutions, and alterations could be made hereto without departing from the spirit and scope of the invention as defined by the appended claims.

I claim:

1. A device for restraining a user while swimming in a body of water, the device comprising:

a length adjustable post having a top end and a bottom end;

a tie portion coupled to a top end portion of the post;

a tether assembly having a first end and second end with the first end bring coupled to the tie portion and the second end being coupled to a restraining belt wherein the belt is adapted to be positioned around a user;

an anchor assembly coupled to a medial portion of the length adjustable post, the anchor assembly includes:

an anchoring collar freely engaged to slide along the medial portion of the length adjustable post;

a damper having one end coupled to said anchoring collar and an opposite end coupled to one end of an anchor cord wherein an opposite end of said anchor cord is adapted to be anchored; and a base assembly coupled to the bottom end of the length adjustable post via a swiveling mechanism, the base assembly having a top portion and a bottom portion, the bottom portion being adapted to be stably positioned on an underwater floor such that when the post is positioned vertically and partially submerged underwater with the bottom end being pivotally supported on the base assembly and the anchor cord is anchored down, as the user supplies a variable force to the length adjustable post, the anchoring collar supplies a counteracting tensile force to the post and the tether assembly supplies the variable force to the post exerted by the user.

2. The device according to claim 1 further including a retainment ring adjustably disposed coaxially on the post, the retainment ring being adapted to contact the anchoring collar to stop the anchoring collar from movably sliding along the post past the retainment ring.

3. The device according to claim 1 wherein the base assembly is releasably coupled to the post.

4. The device according to claim 1 wherein the base element includes a plurality of grip portions.

5. The device according to claim 1 wherein the swiveling mechanism includes a swivel coupling arrangement, the swivel coupling arrangement includes a swivel body and a stem body, the swivel body is fixed to the post and the stem body joins with the swivel body to thus define a first rotational axis for the post.

6. The device according to claim 5 wherein the stem body defines a stem end portion, the stem end portion joins with the base element to define a second rotational axis for the post.

7. The device according to claim 6 wherein the top portion of the base element defines a base anchor and wherein the stem end portion is configured to fixedly receive the base anchor of the base element.

8. The device according to claim 1 wherein the post includes a plurality of segments.

9. The device according to claim 8 wherein at least one segment of the plurality of segments locks in position.

10. The device according to claim 1 wherein the post includes a plurality of telescoping segments.

11. The device according to claim 1 wherein the anchor assembly is in adapted to be secured to a surrounding environment adjacent to the underwater floor.

* * * * *